US007689147B2

(12) United States Patent
Hatakeyama et al.

(10) Patent No.: US 7,689,147 B2
(45) Date of Patent: Mar. 30, 2010

(54) DEVELOPING APPARATUS AND DEVELOPER COLLECTING METHOD

(75) Inventors: Takashi Hatakeyama, Yokohama (JP); Hiroshi Murata, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 824 days.

(21) Appl. No.: 11/479,684

(22) Filed: Jun. 30, 2006

(65) Prior Publication Data

US 2008/0003020 A1 Jan. 3, 2008

(51) Int. Cl.
*G03G 15/04* (2006.01)
*G03G 15/08* (2006.01)

(52) U.S. Cl. ..... 399/119; 399/252

(58) Field of Classification Search ..... 399/119, 399/120, 252, 264

See application file for complete search history.

(56) References Cited

U.S. PATENT DOCUMENTS 5,987,280 A * 11/1999 Sato et al. ..... 399/119
2003/0202823 A1* 10/2003 Tamura ..... 399/227
2004/0047651 A1* 3/2004 Koyama et al. ..... 399/120

FOREIGN PATENT DOCUMENTS

| | | |
|---|---|---|
| JP | 05-289504 | 11/1993 |
| JP | 09-090725 | 4/1997 |
| JP | 09-269642 | 10/1997 |

* cited by examiner

*Primary Examiner*—David M Gray
*Assistant Examiner*—Joseph S Wong
(74) *Attorney, Agent, or Firm*—Turocy & Watson, LLP

(57) ABSTRACT

There are provided a developing apparatus and a developer collecting method, in which a collection unit to collect a developer discharged from a developing unit by overflow is disposed not to largely protrude to the outside of an installation space of the developing unit. There are included a developing unit 12 including a discharge port 30 to discharge a developer by overflow, and a developer collecting unit 34 that is disposed so that at least a part overlaps with the developing unit 12 when the developing unit 12 is viewed from above, and contains the developer discharged from the discharge port 30 of the developing unit 12.

18 Claims, 10 Drawing Sheets

FITTING STATE

DEVELOPING APPARATUS AND DEVELOPER COLLECTING METHOD

BACKGROUND OF THE INVENTION

1. Field of the Invention

The present invention relates to a developing apparatus and a developer collecting method.

2. Description of the Related Art

Heretofore, a developer supplying device and a developer collecting container are united and are attached as a developer supplying and collecting unit to a developing unit and constitute a developing apparatus. In this case, the developer supplying device is provided to be positioned at an upper side end part of the developing apparatus, the developer collecting container is provided to be positioned at a side part of the developing apparatus, and these devices are detachably mounted to the developing apparatus.

A developer taking-in port to take in the developer from the developer supplying device is provided in the upper side end part of the developing unit, and a developer discharge port to discharge the developer by overflow to the outside of the developing apparatus is provided in the developing unit.

On the other hand, a developer supplying port communicating with the developer taking-in port is provided in the lower side end part of the developer supplying device, and a developer collecting port communicating with the developer discharge port is provided in the side part of the developer collecting container. By this, the developer supplied from the developer supplying port of the developer supplying device through the developer taking-in port of the upper part of the developing unit is used in the developing apparatus, and is collected into the developer collecting container from the developer discharge port of the side part of the developing unit through the developer collecting port (see, for example, JP-A-5-289504).

However, in the foregoing technique, since the developer collecting unit is disposed at the side part and the upper part of the developing unit, the developer collecting unit largely protrudes in the horizontal direction and the vertical direction of the developing apparatus. Thus, the whole apparatus becomes large, and a large installation space is required.

SUMMARY OF THE INVENTION

The invention has been made in order to solve the foregoing problem, and it is an object to provide a developing apparatus and a developer collecting method, in which a developer supplying unit to supply a developer to a developing unit and a collection unit to collect the developer discharged from the developing unit by overflow are disposed not to largely protrude to the outside of the developing unit, so that the developing apparatus is miniaturized and a large installation space is not required.

In order to solve the foregoing problem, a developing apparatus according to an aspect of the invention has a following structure and includes a developing unit including a discharge port to discharge a developer by overflow, and a developer collecting unit that is disposed so that at least a part overlaps with the developing unit when the developing unit is viewed from above, and contains the developer discharged from the discharge port of the developing unit.

Besides, a developing apparatus according to an aspect of the invention has a following structure and includes developer supply means for supplying a developer to image bearing means, discharge means provided in the developer supply means and for discharging the developer from the developer supply means by overflow, and developer collection means disposed so that at least a part overlaps with the developer supply means when the developer supply means is viewed from above, and for containing the developer discharged by the discharge means.

Further, a developer collecting method in a developing unit according to an aspect of the invention is a developer collecting method in a developer, has a following structure, and includes steps of forming a stepped part having a side part and a bottom part at an outer peripheral part of a housing of the developing unit, providing a discharge port to discharge a developer to the side part, mounting a developer collecting unit detachably to an upper surface of the bottom part of the stepped part, connecting a collection port provided in the developer collecting unit to the discharge port, discharging the developer from the discharge port by overflow, and collecting the discharged developer from the collection port.

According to the structure of the invention, at least part of the developer collecting unit can be disposed so as to overlap with the developing unit, and does not largely protrude to the outside of developing unit. By this, the whole developing apparatus can be miniaturized, and the space for disposing the developing apparatus can be made small.

Besides, since the developer discharged by the overflow from the discharge port of the developing unit can be directly collected into the developer collecting unit, a complicated mechanism is not required, and the developer can be collected without a mechanism.

DESCRIPTION OF THE DRAWINGS

FIG. 9(*b*) is an outer appearance perspective view showing a state where the developer supplying bottle of embodiment 3 is separated into a developer supplying unit and a developer collecting unit.

DESCRIPTION OF THE EMBODIMENTS

Hereinafter, embodiments of the invention will be described with reference to the drawings.

Embodiment 1

Figure 1:
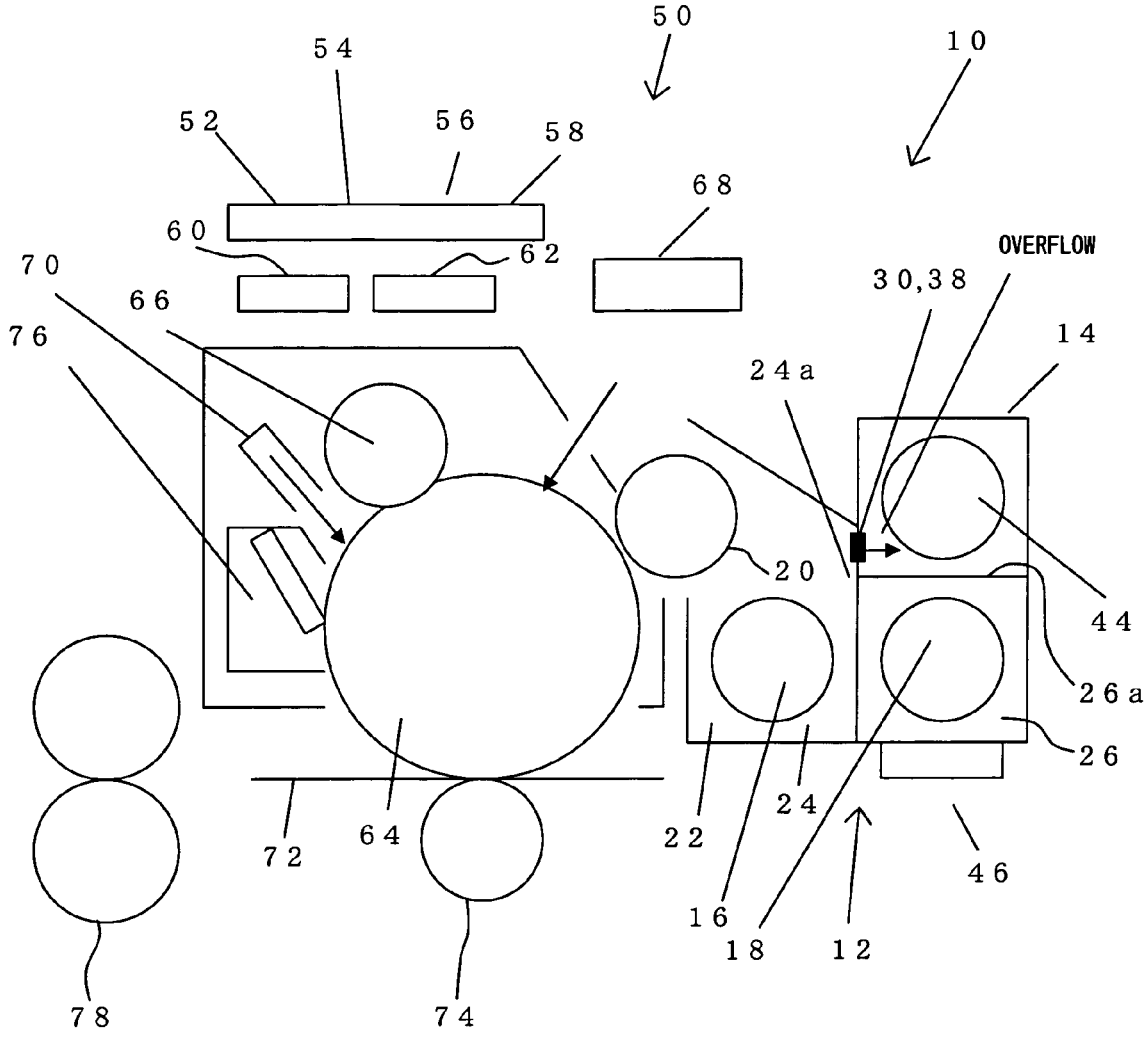
FIG. 1 is a structural view of a copying machine as an image forming apparatus according to an embodiment.
Figure 2:
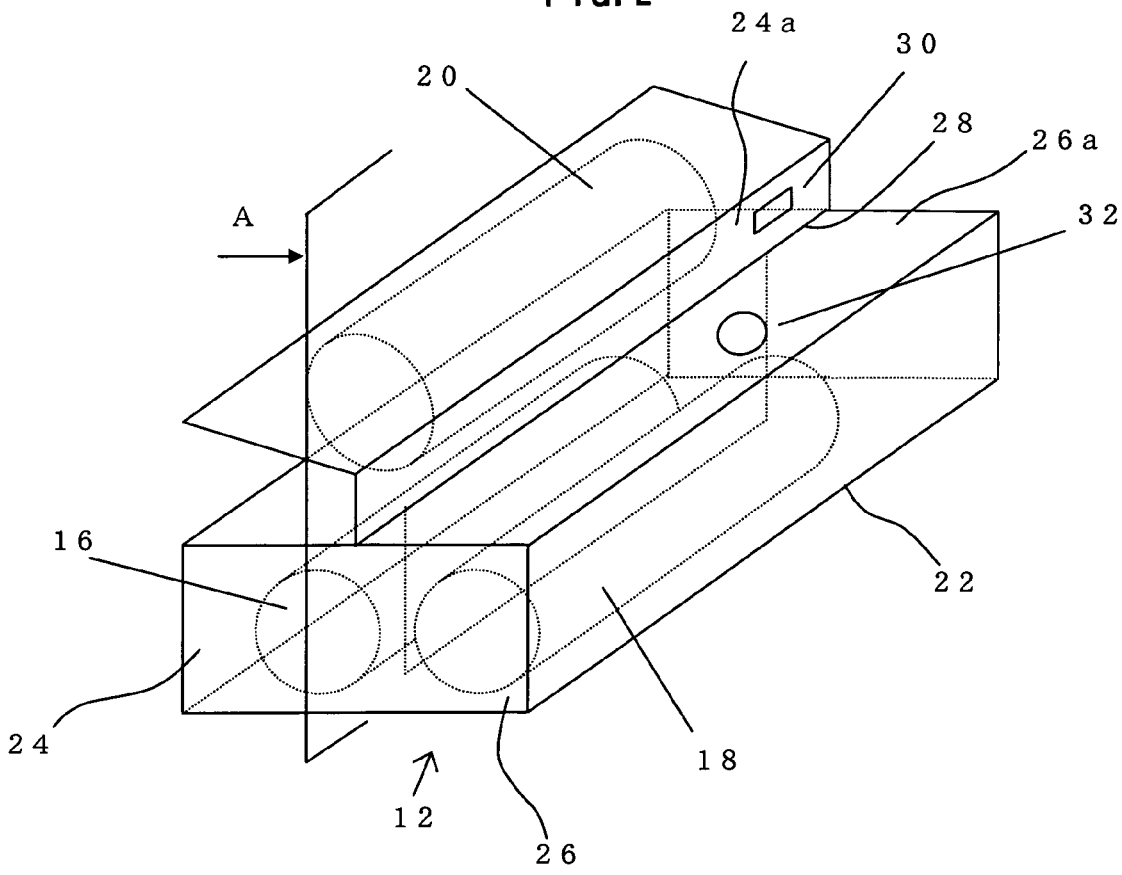
FIG. 2 is an outer appearance perspective view of a developing unit mounted to the copying machine.
Figure 3:
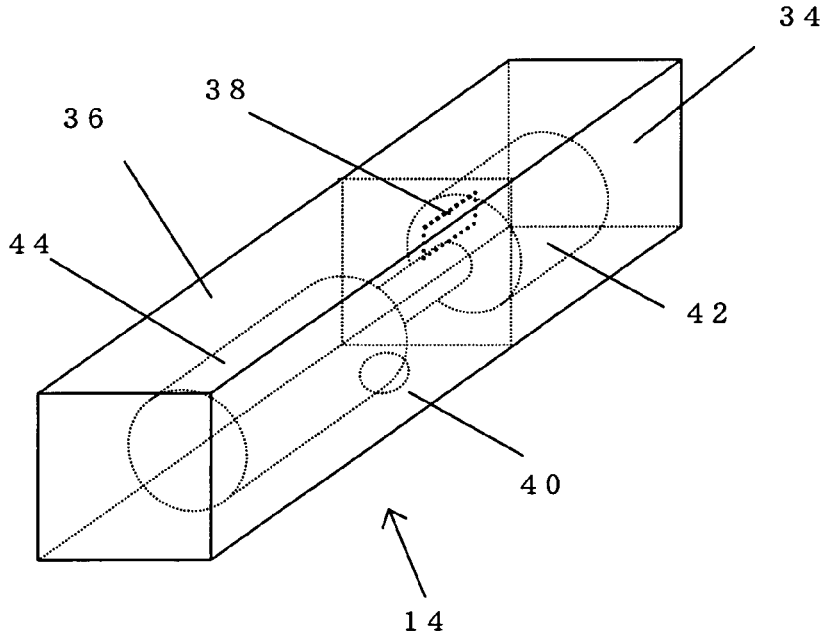
FIG. 3 is an outer appearance perspective view of a developer supplying bottle mounted to the copying machine.
Figure 4:
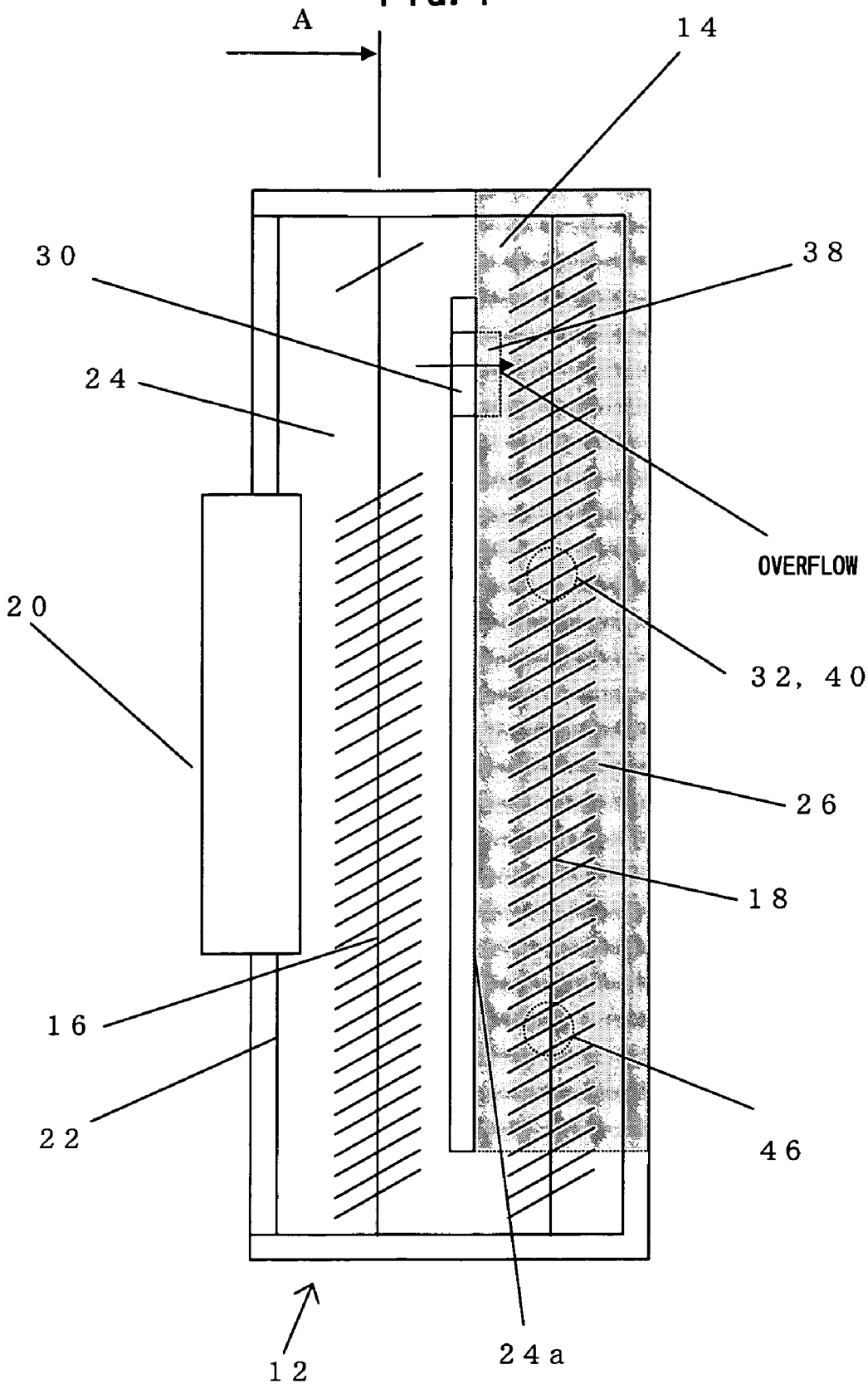
FIG. 4 is a sectional view when the developing unit is viewed from above.
Figure 5:
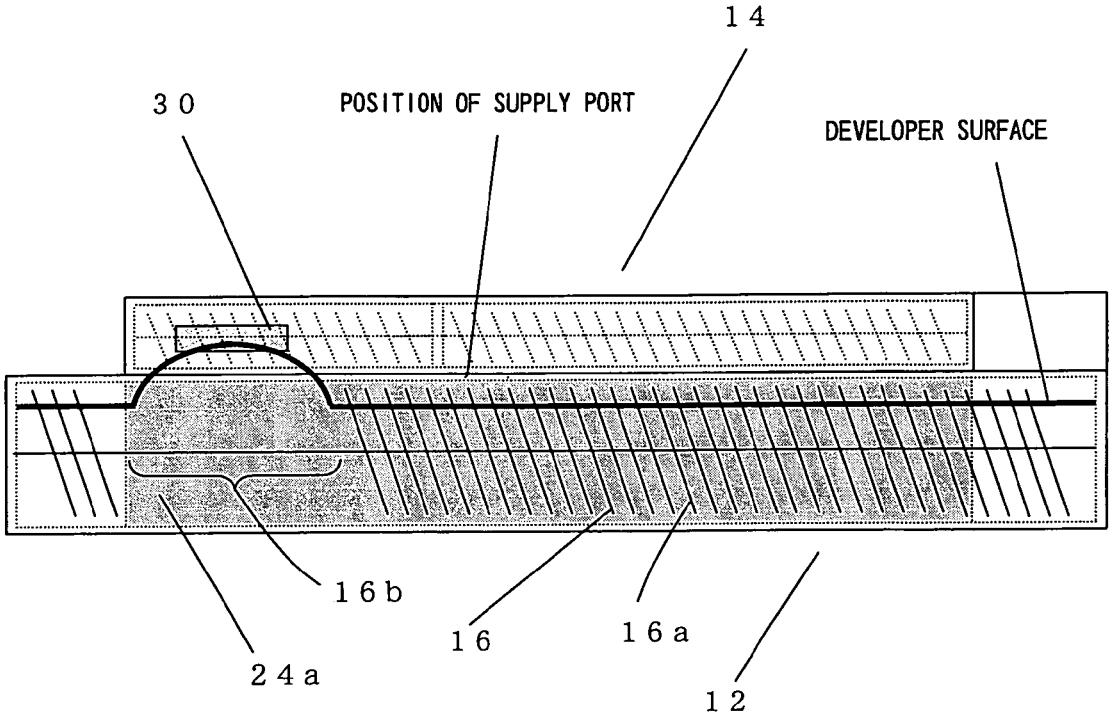
FIG. 5 is an A-A sectional view of FIG. 2 and FIG. 4.
Figure 6:
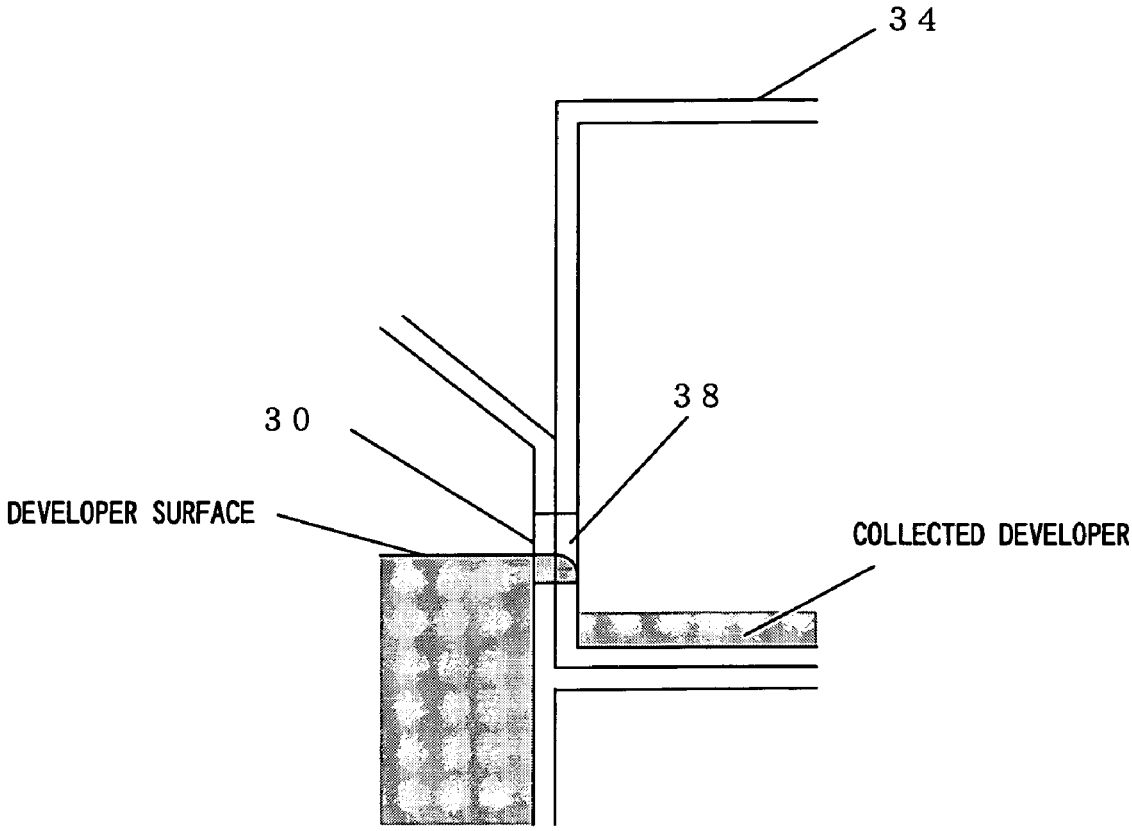
FIG. 6 is a sectional view of the vicinity of a discharge port in a state where a developer supplying bottle of embodiment 1 is mounted to a developing unit.

FIG. 1 is a structural view of a copying machine as an image forming apparatus according to an embodiment, FIG. 2 is an outer appearance perspective view of a developing unit mounted to the copying machine, FIG. 3 is an outer appearance perspective view of a developer supplying bottle mounted to the copying machine, FIG. 4 is a sectional view when the developing unit is viewed from above, FIG. 5 is an A-A sectional view of FIG. 2 and FIG. 4, and FIG. 6 is a sectional view of the vicinity of a discharge port in a state where a developer supplying bottle of embodiment 1 is mounted to the developing unit.

A developing apparatus 10 includes a developing unit 12 and a developer supplying bottle 14 attachably and detachably provided to the developing unit 12.

The developing unit 12 includes at least two agitating and transporting members 16 and 18 to agitate and transport a developer, a developing roller 20 disposed above the agitating and transporting members 16 and 18, and a containing unit 22 to contain the developer.

The containing unit 22 includes a first space 24 in which the developing roller 20 and at least the one agitating and transporting member 16 adjacent to the developing roller 20 are disposed, and a second space 26 in which the other agitating and transporting member 18 different from the agitating and transporting member 16 is disposed and which is lower than the first space 24 in space height.

In the outer shape of the containing unit 22, as is apparent from FIG. 2, there is included a stepped part 28 formed of a side wall part 24*a* which is a side wall (side wall back surface of the first space) forming the first space 24, and a bottom part 26*a* which is an upper wall (upper wall back surface of the second space) forming the second space 26. A discharge port 30 to discharge the developer by overflow is provided in the side wall part 24*a* of the stepped part 28, and an injection port 32 to inject the developer is provided in the bottom part 26*a*.

By this, the stepped part including the side wall part and the bottom part is formed on the outer peripheral part of the upper part of a housing of the developing unit, and the discharge port is provided in the side wall part of the stepped part.

As shown in FIG. 5, an auger with a spiral pitch of 25 mm and an outer diameter of 20 mm is used as the agitating and transporting member 16. A non-spiral part 16*b* which has a width of 50 mm and in which a spiral 16*a* is not provided is formed in the vicinity of the discharge port 30, and the non-spiral part 16*b* is a swelling structure to swell the developer in the vicinity of the discharge port 30.

The reason why the non-spiral part becomes the swelling structure is that the action to agitate and transport the developer is reduced in the portion where the spiral 16*a* is not provided, and the developer is accumulated in this portion, and consequently, the developer is swelled. The developer swelled as stated above is discharged from the discharge port 30. In the case of the agitating and transporting member 16 having the above shape, the swelling of the developer becomes about 10 mm.

Incidentally, since the swelling structure is the structure in which the outer shape of the agitating and transporting member 16 in the vicinity of the discharge port 30 is made the shape different from that of the other portion, it is not limited to one in which the non-spiral part 16*b* is formed in the agitating and transporting member 16 as stated above.

That is, the swelling structure can also be constructed by changing the spiral pitch of the agitating and transporting member 16 in the vicinity of the discharge port 30. For example, in the agitating and transporting member 16 with the above size, the same swelling effect as the agitating and transporting member 16 can also be obtained by changing the pitch of the spiral to ¼ over a width of 50 mm in the vicinity of the discharge port 30.

Besides, the swelling structure may be constructed by causing the outer diameter size of the agitating and transporting member 16 in the vicinity of the discharge port 30 to become smaller than the other portion.

As shown in FIG. 3, the developer supplying bottle 14 includes a developer collecting unit 34 to contain the developer discharged from the discharge port 30 of the developing unit 12, and a developer supplying unit 36 to supply the developer from the injection port 32 of the developer provided in the developing unit 12, and the developer collecting unit 34 and the developer supplying unit 36 are integrally constructed.

As shown in FIG. 4 and FIG. 6, a collection port 38 faced to and connected to the discharge port 30 at the time of mounting to the developing unit 12 is formed in the side part of the developer collecting unit 34. Besides, as shown in FIG. 3, a transporting member 42 to move the developer, which has entered from the collection port 38, to the inner part of the developer collecting unit 34 is disposed in the developer collecting unit 34.

As shown in FIG. 3, a supply port 40 to be connected to the injection port 32 at the time of mounting to the developing unit 12 is formed in the bottom part of the developer supplying unit 36, and a transporting member 44 to send out the developer through the supply port 40 is disposed in the developer supplying unit 36.

As shown in FIG. 1, FIG. 4 and FIG. 5, the developer supplying bottle 14 is mounted such that the whole bottom part of the developer supplying bottle 14 overlaps with the bottom part 26*a* of the stepped part 28 of the developing unit 12.

In this embodiment, the developer collecting unit 34 and the developer supplying unit 36 of the developer supplying bottle 14 are disposed to overlap with the bottom part 26*a* of the stepped part 28. However, the space-saving effect occurs also when at least a part of the developer collecting unit 34 and the developer supplying unit 36 overlaps with the upper surface of the bottom part 26*a* when the developing unit 12 is viewed from above.

Incidentally, in the developing unit 12, in addition to the above respective structural members, a toner density sensor 46 to magnetically detect the toner density in the developing unit 12 is provided at the bottom part of the second space part 26.

In FIG. 4, the developer is transported in a clockwise direction by the agitating and transporting members 16 and 18.

Next, based on FIG. 1, the structure of a copying machine 50 according to the embodiment except the developing apparatus 10 will be described.

The copying machine 50 includes a combination panel 58 in which a copy button 52 of copying, a copy number button 54 to input the number of copies, a display 56 to display information of the copying machine 50, and the like are provided. In addition, there are disposed a CPU 60 to control the copying, a memory 62 to store data necessary to perform a control, a photoconductive body (image bearing body, image bearing means) 64, a charging apparatus (charging unit, charging means) 66 to charge the photoconductive body 64, an exposure apparatus (electrostatic latent image formation unit, electrostatic latent image formation means) 68 to form an electrostatic latent image on the photoconductive body 64, the developing apparatus 10 to supply a developer to the electrostatic latent image by the developing roller (developer bearing body, developer bearing means) 20 to develop the electrostatic latent image, an electricity removal apparatus 70 to remove electricity on the surface of the photoconductive body 64, a transfer apparatus (transfer unit, transfer means) 74 to transfer a toner image from the photoconductive body 64 to a sheet (transfer member) 72, a cleaner apparatus 76 to remove a residual toner on the photoconductive body 64 by a blade, and fixing apparatus (fixing unit, fixing means) to fix the toner to the sheet 72.

Besides, a process cartridge includes at least one of the developing unit 12, the charging apparatus 66, and the cleaner apparatus 76 and the photoconductive body 64, and the process cartridge is attachably and detachably provided to the main body of the copying machine 50.

Next, the operation at the time of recording will be described.

The number of copies is inputted by the copy number button 54 of the combination panel 58, and when the copy button 52 is pressed, the operation of image formation is started based on image information from a not-shown scanner.

The surface of the photoconductive body 64 is charged by the charging apparatus 66 through the control of the CPU 60, the exposure corresponding to an image is performed by the exposure apparatus 68, and an electrostatic latent image is formed on the photoconductive body 64. The latent image on the photoconductive body 64 is developed by the developer on the developing roller 20 of the developing unit 12, and a developer image is formed on the photoconductive body 64. The developer well agitated by the agitating and transporting members 16 and 18 is always transported to the developing roller 20.

The developer image formed on the photoconductive body 64 is electrostatically transferred onto the transported sheet 72 by the transfer apparatus 74, and then is fixed to the sheet 72 by heat press of the fixing apparatus 78. By this, a specified image is formed.

Besides, with respect to the photoconductive body 64 after the transfer to the sheet 72, the residual toner is removed by the cleaner apparatus 76 including the blade, and the electricity is removed by irradiation of light from the electricity removal apparatus 70.

The operation is repeated by the inputted number of copies, and the copy operation is ended.

The toner whose amount is equal to the toner consumed by the development is sent from the developer supplying unit 36 of the developer supplying bottle 14 by the transport member 44 through the supply port 40, and is supplied from the injection port 32 into the developing unit 12. Since the developer is supplied in this way, a trace amount of carrier is supplied into the developing unit 12 simultaneously with the toner. However, in the case where the developer is increased by that, the developer in the vicinity of the discharge port 30 is swelled up by the swelling structure of the agitating and transporting member 16 to the developer surface shown in FIG. 6, and is discharged from the discharge port 30 by overflow. As shown in FIG. 6, the discharged developer directly enters the developer collecting unit 34 of the developer supplying bottle 14 from the collection port 38 connected to the discharge port 30, and is accumulated there. Since the developer in the vicinity of the collection port 38 is transported to the inner part of the developer collecting unit 34 by the transporting member 42, the developer is not accumulated in the vicinity of the collection port 38, and the collection can be excellently performed.

As stated above, by replacing the deteriorated developer in the developing unit 12 by a new toner and carrier, developing performance is maintained and deterioration of picture quality can be suppressed.

Besides, in this embodiment, the toner density in the developing unit 12 is magnetically detected by the toner density sensor 46, the supply amount of toner is determined according to the output of the toner density sensor 46, and the developer supply amount is controlled.

The foregoing operation is suitably repeated and the copy operation is performed.

As described above, with respect to the developer supplying bottle 14, the stepped part is formed in the outer shape of the developing unit 12, and the developer supplying bottle 14 is mounted so as to fill the space of the formed stepped part, and therefore, the developer supplying bottle 14 can be disposed in the installation space of the developing unit 12. By this, the developing apparatus 10 can be miniaturized, and the installation space can also be made small. Besides, since the developer discharged from the discharge port 30 can be directly collected to the developer collecting unit 34 from the collection port 38, a complicated mechanism is not required and the apparatus can be simplified.

Embodiment 2

Although embodiment 2 will be described with reference to FIG. 7 and FIG. 8, since it is similar to embodiment 1 except a structure in the vicinity of a discharge port 30 of a developing unit 12 and a collection port 38 of a developer supplying bottle 14, the description of portions redundant to those of embodiment 1 will be omitted.

Figure 7:
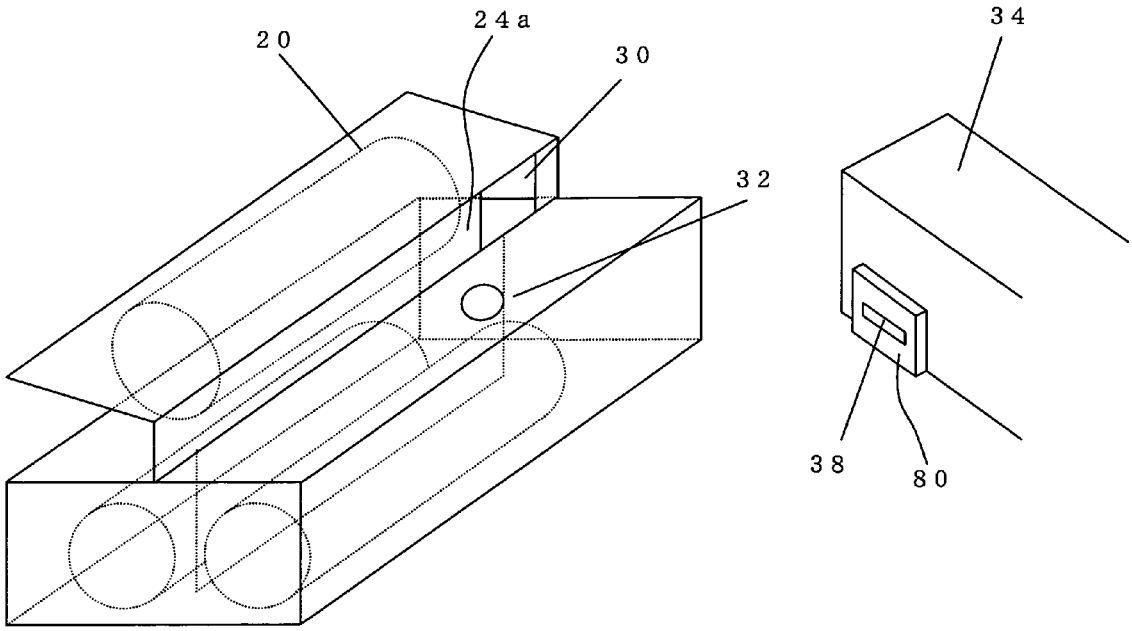
FIG. 7 is an outer appearance perspective view showing a developing unit of embodiment 2 and the vicinity of a collection port of a developer supplying bottle.
Figure 8:
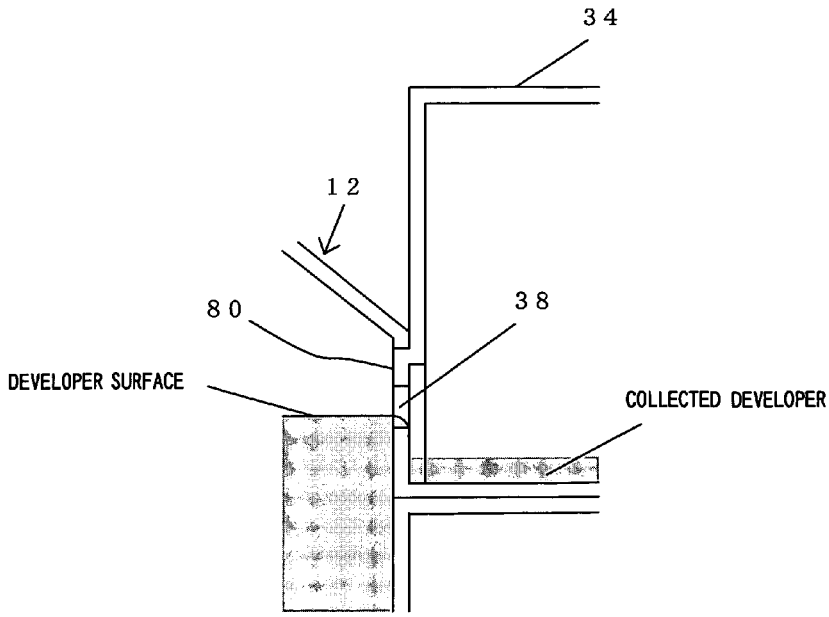
FIG. 8 is a sectional view of the vicinity of a discharge port in a state where the developer supplying bottle of embodiment 2 is mounted to the developing unit.

FIG. 7 is an outer appearance perspective view showing the developing unit 12 of embodiment 2 and the vicinity of the collection port 38 of the developer supplying bottle 14, and FIG. 8 is a sectional view of the vicinity of the discharge port 30 in a state where the developer supplying bottle 14 of embodiment 2 is mounted to the developing unit 12.

In the developing unit 12, the discharge port 30 to discharge a developer by overflow is provided in a side wall part 24*a* of a stepped part 28 over the whole length of the side wall part 24*a* in the height direction, a protrusion 80 capable of being fitted in the discharge port 30 is formed at the side part of a developer collecting unit 34, and the collection port 38 is provided in the protrusion 80. When the developer supplying bottle 14 is mounted to the developing unit 12, the protrusion 80 is fitted in the discharge port 30, and the discharge port 30 and the collection port 38 are connected to each other. Incidentally, the shape of the collection port 38 is a laterally long rectangle, and the height position and height width of the collection port 38 are made such that the overflown developer can be suitably collected as shown in FIG. 8.

Next, although the operation of embodiment 2 will be described, since it is similar to embodiment 1 except the operation described below, the description of portions redundant to those of embodiment 1 will be omitted.

As shown in FIG. 8, when the developer swelled in the vicinity of the discharge port 30 by a swelling structure of an agitating and transporting member 16 is swelled up to a developer surface shown in FIG. 8, it directly enters the developer collecting unit 34 through the collection port 38 by overflow, and is accumulated in the developer collecting unit 34.

Embodiment 3

Although embodiment 3 will be described with reference to FIG. 9(*a*) and FIG. 9(*b*), since it is similar to embodiment 1 except a structure and operation described below, the description of portions redundant to those of embodiment 1 will be omitted.

Figure 9:
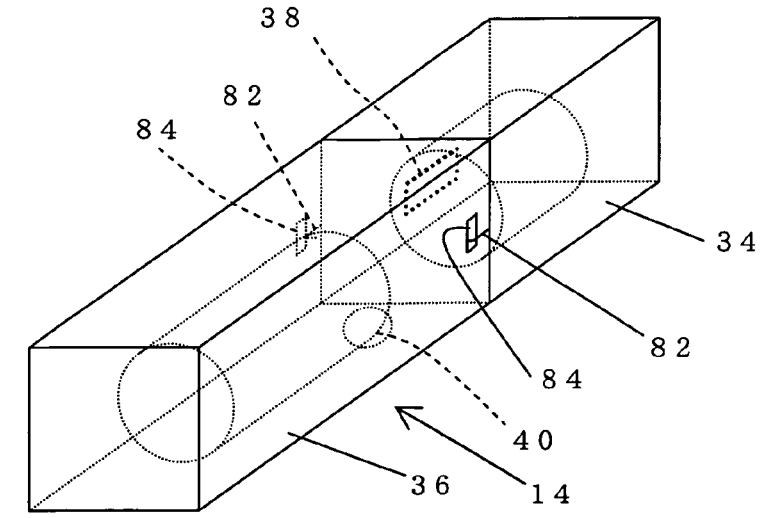
FIG. 9(*a*) is an outer appearance perspective view showing a developer supplying bottle of embodiment 3.
Figure 9:
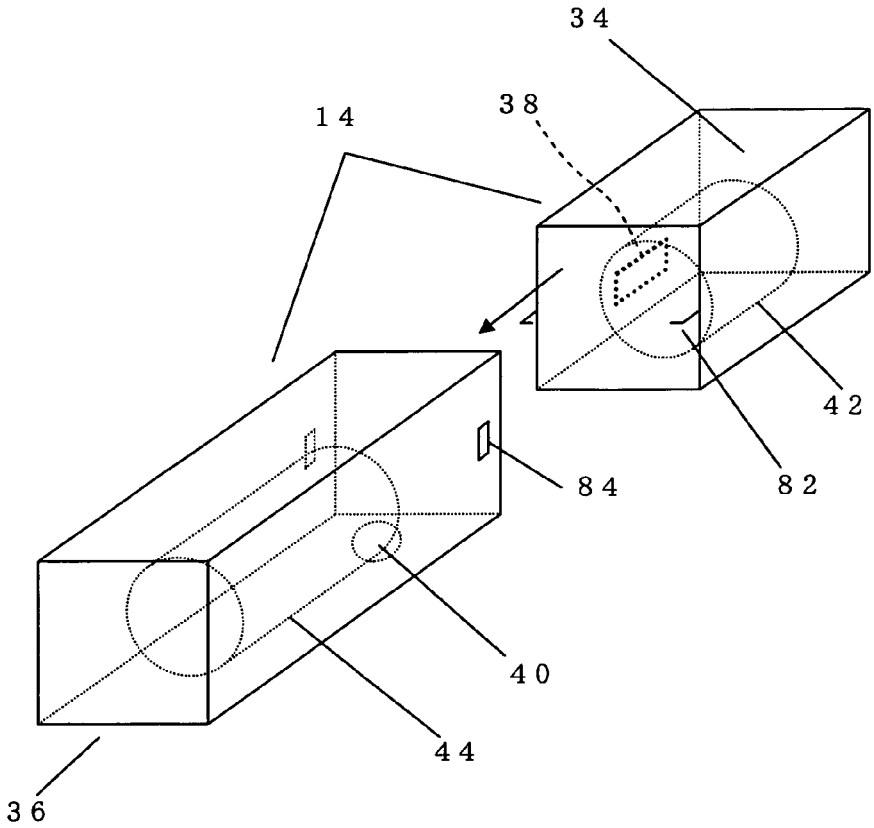

FIG. 9(*a*) is an outer appearance perspective view showing a developer supplying bottle 14 of embodiment 3, and FIG. 9(*b*) is an outer appearance perspective view showing a state where the developer supplying bottle of embodiment 3 is separated into a developer supplying unit 36 and a developer collecting unit 34.

In the developer supplying bottle 14, the developer collecting unit 34 and the developer supplying unit 36 are separate bodies and are attachable to and detachable from each other. Hooks 82 are provided at both side walls of the developer collecting unit 34 close to the developer supplying unit 36, and hook stops 84 which can be engaged with the hooks 82 are provided at both side walls of the developer supplying unit 36.

Next, the operation will be described.

When the developer collecting unit 34 and the developer supplying unit 36 are fitted to each other, the hooks 82 are engaged with the hook stops 84. When the developer collecting unit 34 and the developer supplying unit 36 are separated from each other, the hooks 82 are unhooked from the hook stops 84. The attachment to and detachment from the developing unit 12 is performed in a state where the developer collecting unit 34 and the developer supplying unit 36 are fitted to each other. The state after the fitting is similar to that of embodiment 1.

Embodiment 4

Although embodiment 4 will be described with reference to FIG. 10 and FIG. 11, since it is similar to embodiment 3 except a structure and operation described below, the description of portions redundant to those of embodiment 3 will be omitted.

Figure 10:
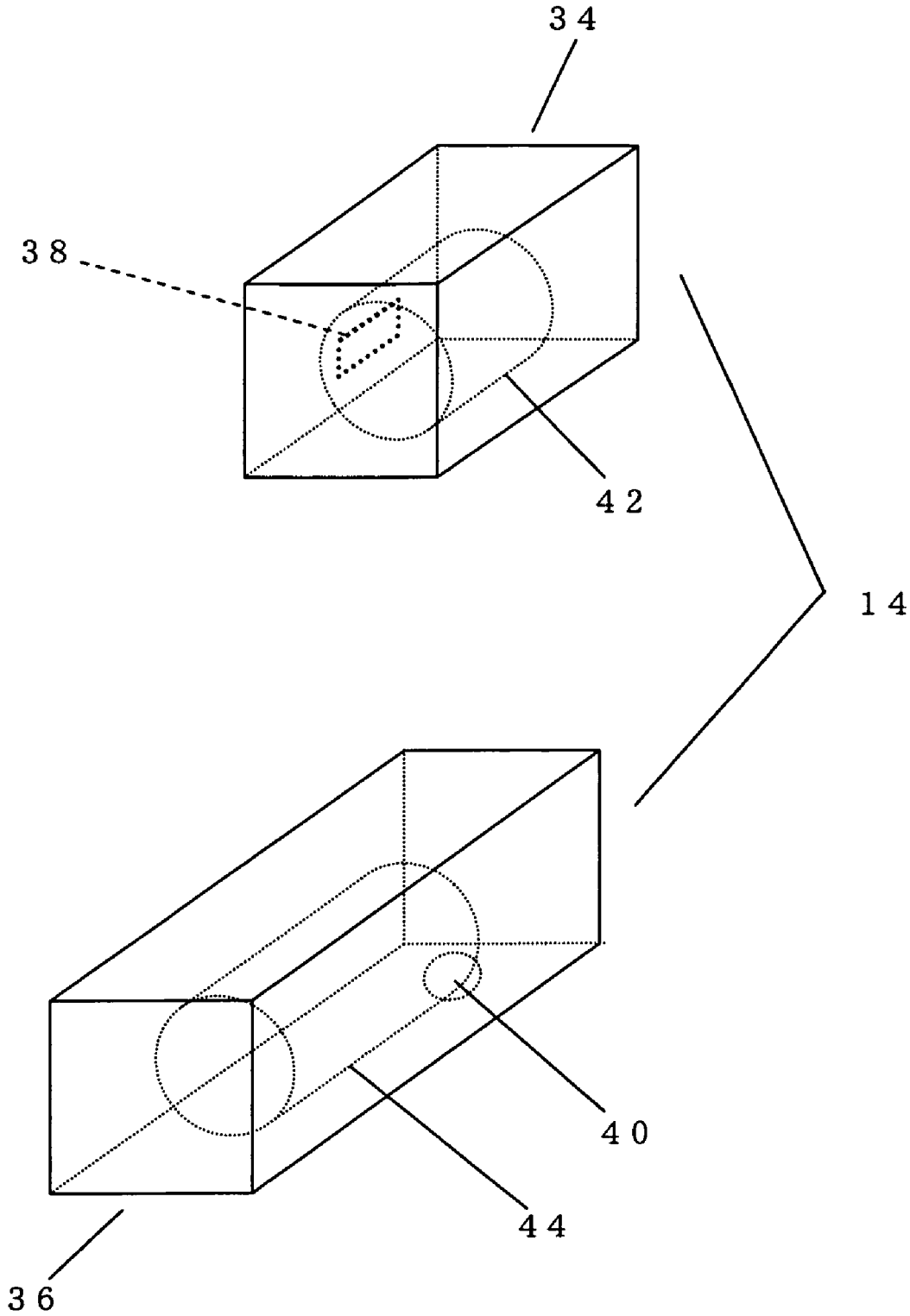
FIG. 10 is an outer appearance perspective view showing a developer supplying bottle of embodiment 4.
Figure 11:
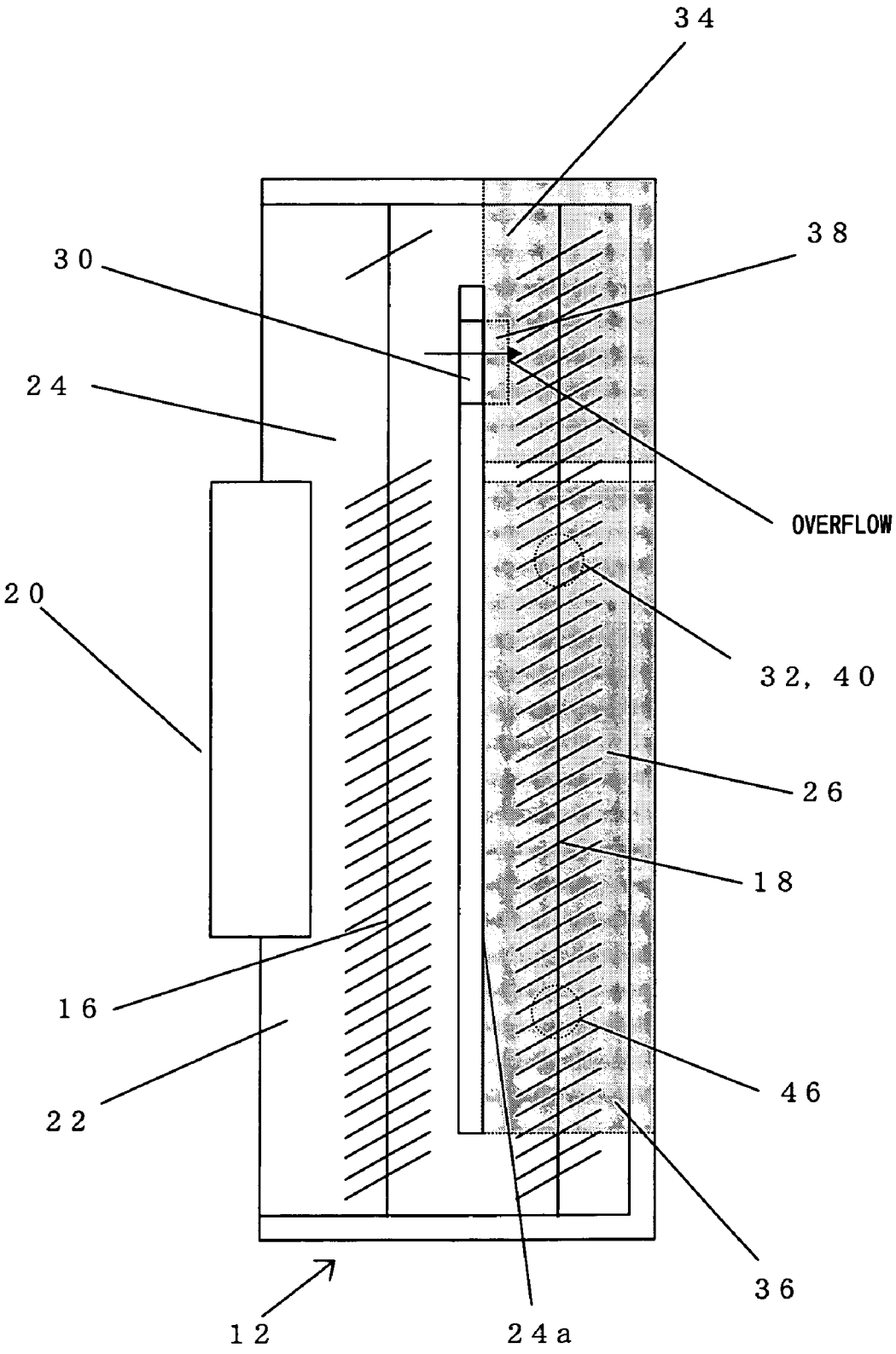
FIG. 11 is a sectional view when a state where the developer supplying bottle of embodiment 4 is mounted to a developing unit is viewed from above.

FIG. 10 is an outer appearance perspective view showing a developer supplying bottle 14 of embodiment 4, and FIG. 11 is a sectional view when a state where the developer supplying bottle 14 of embodiment 4 is mounted to a developing unit 12 is viewed from above.

In embodiment 4, a developer collecting unit 34 and a developer supplying unit 36, which constitute the developer supplying bottle 14 in embodiment 1, are formed to be separate bodies, and are, as shown in FIG. 11, attachably and detachably disposed on the upper surface of a bottom part 26*a* of the developing unit 12, respectively.

Besides, in embodiment 4, the hooks 82 provided in the developer collecting unit 34 of embodiment 3, and the hook stops 84 provided in the developer supplying unit 36 are not respectively provided, and the developer collecting unit 34 and the developer supplying unit 36 are not fitted to each other. Other than that, the structure is similar to embodiment 3.

Embodiment 5

Although embodiment 5 will be described with reference to FIG. 12, since it is similar to embodiment 1 except a structure and operation described below, the description of portions redundant to those of embodiment 1 will be omitted.

Figure 12:
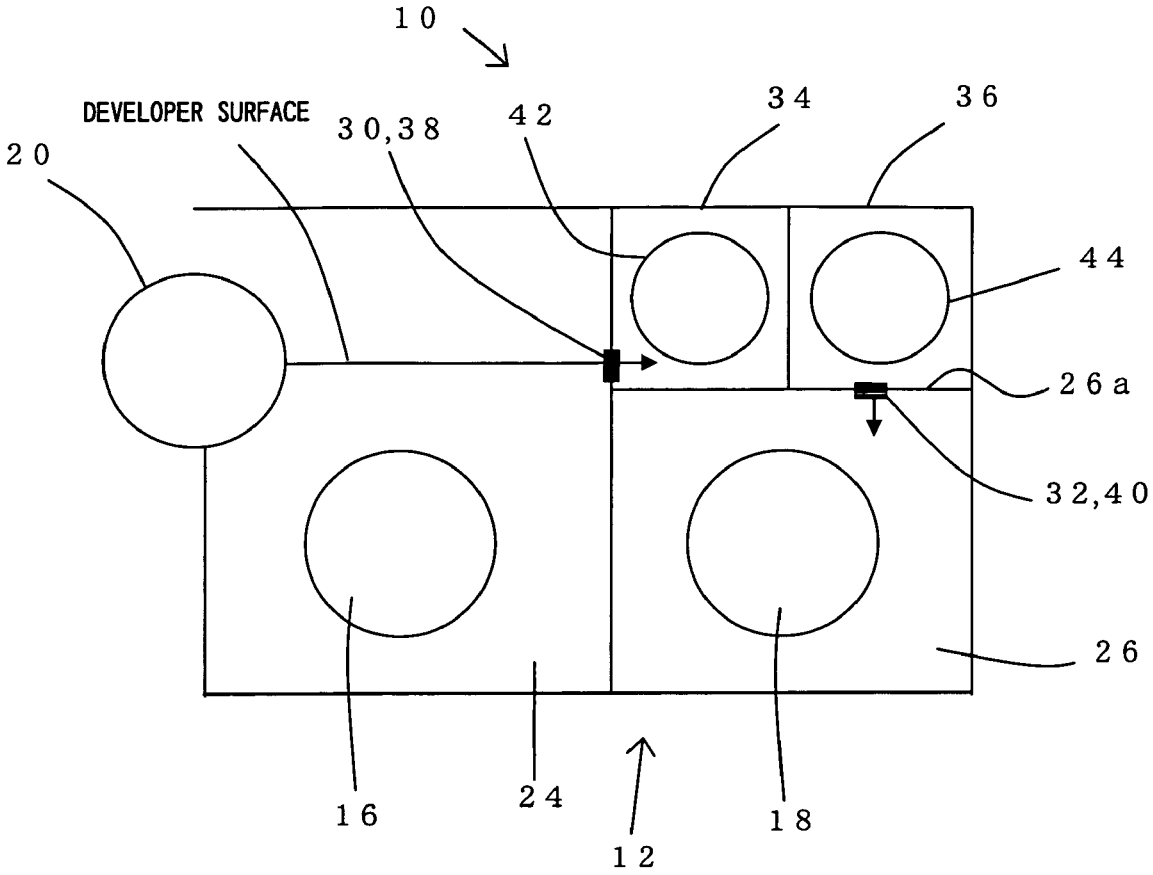
FIG. 12 is a schematic structural view when a developing apparatus of embodiment 5 is viewed from a rotation axis direction of an agitating and transporting member.

FIG. 12 is a schematic structural view when a developing apparatus of embodiment 5 is viewed from a rotation axis direction of an agitating and transporting member 18.

In embodiment 5, a developer collecting unit 34 and a developer supplying unit 36 are disposed on an upper surface of a bottom part 26*a* of a stepped part of a developing unit 12 to be perpendicular to the rotation axis of the agitating and transporting member 18 and to be in parallel to each other in the horizontal direction, and are detachably mounted to the developing unit 12.

The developer collecting unit 34 and the developer supplying unit 36 may be integrally constructed as in embodiment 1, or may be constructed such that they are separate bodies which can be attached to and detached from each other as in embodiment 3 and are mounted to the developing unit 12 after they are fitted to each other, or may be constructed such that they are separate bodies as in embodiment 4 and are separately mounted to the developing unit 12.

Although the invention has been described in detail with the specific embodiments, it would be apparent for one skilled in the art that various modifications and improvements can be made insofar as they do not depart from the spirit and scope of the invention.

As described above, according to the embodiments of the invention, it is possible to provide the developing apparatus and the developer collecting method in which the developer supplying unit to supply the developer to the developing unit and the collecting unit to collect the developer discharged from the developing unit by overflow can be disposed without largely protruding to the outside of the installation space of the developing unit.

What is claimed is:

1. A developing apparatus, comprising:

a developing unit including a discharge port to discharge a developer by overflow, the developing unit comprising a developing roller, the developing unit comprising a stepped part having a side wall part and a bottom part on an outer peripheral part of an upper part of a housing of the developing unit, the side wall part extending along a longitudinal direction of the developing roller and being positioned between the developing roller and a developer collecting unit, the discharge port being formed and provided in a part of the side wall part; and the developer collecting unit that is disposed so that at least a part of the developer collecting unit is mounted on an upper surface of the bottom part of the stepped part when the developing unit is viewed from above, and contains the developer discharged from the discharge port of the developing unit.

2. The developing apparatus according to claim 1, wherein the developer collecting unit is attachably and detachably provided to the developing unit, and includes a collection port to be connected to the discharge port of the developing unit at a time of mounting.

3. The developing apparatus according to claim 1, wherein a developer swelling structure to swell the developer in a vicinity of the discharge port is provided in the vicinity of the discharge port of the developing unit.

4. The developing apparatus according to claim 3, wherein the swelling structure is provided in the developing unit, and has a structure that an outer diameter size of an agitating and transporting member, which agitates and transports the developer, in the vicinity of the discharge port is smaller than that of another portion.

5. The developing apparatus according to claim 3, wherein the swelling structure has a structure that an outer shape of an agitating and transporting member, which has a spiral shape and is extended in a transport direction of the developer, in the vicinity of the discharge port is different from a shape of another portion.

6. The developing apparatus according to claim 1, further comprising a developer supplying unit that is attachably and detachably provided to the stepped part of the developing unit and includes a supply port to supply the developer to the developing unit.

7. The developing apparatus according to claim 6, wherein an injection port to inject the developer is formed in the bottom part forming the stepped part of the developing unit, and the supply port formed in a flat wall as a bottom of the developer supplying unit is connected to the injection port at a time when the developer supplying unit is mounted to the developing unit.

8. The developing apparatus according to claim 6, wherein the developer collecting unit and the developer supplying unit are provided to be capable of being attached to and detached from each other.

9. The developing apparatus according to claim 6, wherein the developer collecting unit and the developer supplying unit are integrally provided.

10. The developing apparatus according to claim 1, wherein the developing unit includes at least two agitating and transporting members to agitate and transport the developer, the developing roller disposed above the agitating and transporting members, and a container unit to contain the developer, the container unit includes a first space in which the developing roller and at least one agitating and transporting member adjacent to the developing roller are disposed, and a second space in which one agitating and transporting member and the other agitating and transporting member are disposed and is lower than the first space in height-direction position, and the stepped part is formed in which a side wall back surface forming the first space is the side wall, and an upper wall back surface forming the second space is the bottom part.

11. The developing apparatus according to claim 10, wherein the discharge port is provided in the side wall surface above an upper end of the agitating and transporting member.

12. The developing apparatus according to claim 1, wherein an image forming apparatus comprises a charging unit configured to charge an image bearing body, an electrostatic latent image forming unit configured to form an electrostatic latent image on the image bearing body, a developer bearing body configured to supply the developer to the electrostatic latent image, a transfer unit configured to transfer a developer image developed by the developer bearing body onto a transfer member, and a fixing unit configured to fix the developer to the transfer member.

13. The developing apparatus according to claim 12, wherein the image bearing body and the developer bearing body are integrated as one unit, and can be attached to and detached from a main body of the image forming apparatus.

14. A developing apparatus, comprising:

developer supply means for supplying a developer to image bearing means, the developer supply means comprising a developing roller, the developer supply means comprising a stepped part having a side wall part and a bottom part on an outer peripheral part of an upper part of a housing of the developer supply means, the side wall part extending along a longitudinal direction of the developing roller and being positioned between the developing roller and a developer collection means;

discharge means formed and provided in the side wall part of developer supply means and for discharging the developer from the developer supply means by overflow; and the developer collection means disposed so that at least a part of the developer collection means is mounted on an upper surface of the bottom part of the stepped part of developer supply means when the developer supply means is viewed from above, and for containing the developer discharged by the discharge means.

15. The developing apparatus according to claim 14, wherein the discharge means includes a discharge port to discharge the developer, and developer swelling means for swelling the developer in a vicinity of the discharge port.

16. The developing apparatus according to claim 14, comprising developer supply means attachably and detachably provided to the developing means, and including a supply port to supply the developer to the developing means.

17. The developing apparatus according to claim 14, wherein an image forming apparatus comprises charging means for charging image bearing means, electrostatic latent image forming means for forming an electrostatic latent image on the image bearing means, developer bearing means for supplying the developer to the electrostatic latent image, transfer means for transferring a developer image developed by the developer bearing means onto a transfer member, and fixing means for fixing the developer to the transfer member.

18. The developing apparatus according to claim 17, wherein the image bearing means and the developer bearing means are integrated as one unit, and can be attached to and detached from a main body of the image forming apparatus.

* * * * *